US008740674B2

(12) United States Patent
Esenwein

(10) Patent No.: US 8,740,674 B2
(45) Date of Patent: Jun. 3, 2014

(54) GUARD FOR A HAND-HELD POWER TOOL AND HAND-HELD POWER TOOL WITH A GUARD

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 804 days.

(21) Appl. No.: 11/997,032

(22) PCT Filed: Mar. 27, 2007

(86) PCT No.: PCT/EP2007/052899
§ 371 (c)(1),
(2), (4) Date: Jan. 28, 2008

(87) PCT Pub. No.: WO2007/131827
PCT Pub. Date: Nov. 22, 2007

(65) Prior Publication Data

US 2008/0200103 A1 Aug. 21, 2008

(30) Foreign Application Priority Data

May 12, 2006 (DE) ..... 10 2006 022 386

(51) Int. Cl.
*B24B 55/05* (2006.01)

(52) U.S. Cl.
USPC ..... 451/451; 451/359; 451/452

(58) Field of Classification Search
USPC ..... 451/344, 353, 359, 451, 452, 454
See application file for complete search history.

(56) References Cited

U.S. PATENT DOCUMENTS

| | | | | |
|---|---|---|---|---|
| 5,005,321 | A | 4/1991 | Barth et al. | |
| 6,464,573 | B1 * | 10/2002 | Keller | 451/451 |
| 6,988,939 | B2 | 1/2006 | Hofmann et al. | |
| 7,063,606 | B2 * | 6/2006 | Stierle et al. | 451/359 |
| 7,311,589 | B2 * | 12/2007 | Wiker | 451/451 |
| 2004/0014412 | A1 * | 1/2004 | Hofmann et al. | 451/451 |

FOREIGN PATENT DOCUMENTS

| | | |
|---|---|---|
| DE | 36 36 601 | 5/1988 |
| DE | 195 18 854 | 11/1996 |
| DE | 101 24 439 | 11/2002 |
| DE | 101 58 334 | 2/2003 |
| DE | 102 59 520 | 7/2004 |

* cited by examiner

*Primary Examiner* — Eileen P. Morgan
(74) *Attorney, Agent, or Firm* — Michael J. Striker

(57) ABSTRACT

The invention relates to a protective hood for a hand tool, in particular for an electrical hand tool which has a support area for the attachment of a flange of the hand tool, and with a clamping device for fastening the protective hood to the flange as well as an anti-twist device to secure the angle position of the protective hood relative to the hand tool. It is provided that the support area (9) has at least one anti-twist device element (18) working in conjunction with at least one anti-twist device mating element (47) of the flange (34).

23 Claims, 5 Drawing Sheets

Fig. 10
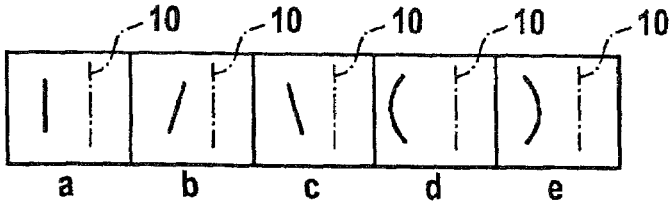
Fig. 11
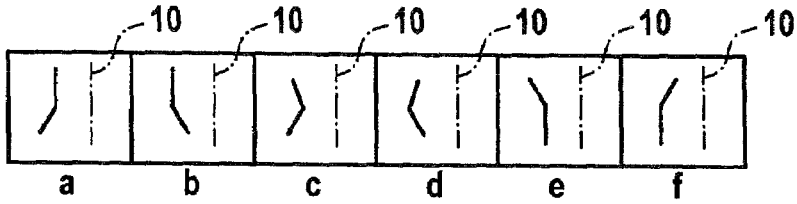
Fig. 12
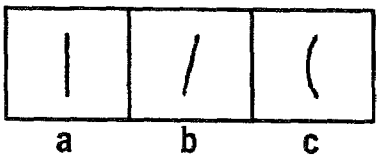
Fig. 13
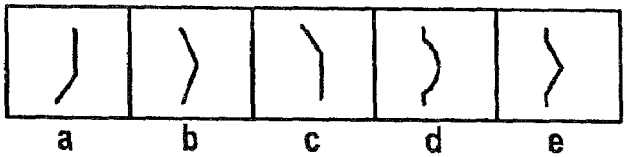
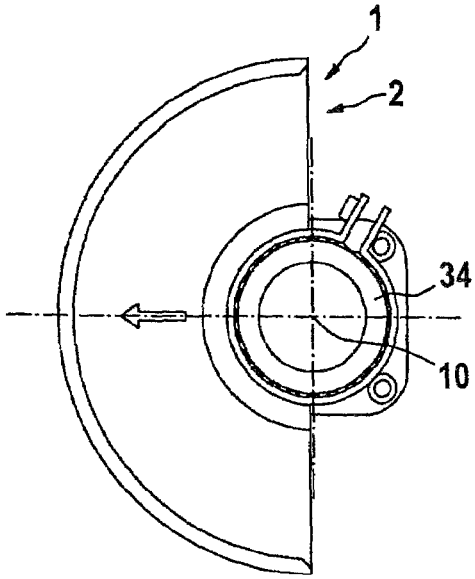
Fig. 14

GUARD FOR A HAND-HELD POWER TOOL AND HAND-HELD POWER TOOL WITH A GUARD

CROSS-REFERENCE TO RELATED APPLICATION

The invention described and claimed hereinbelow is also described in German Patent Application, DE 10 2006 022 386.1 filed on May. 12, 2006. This German patent Application, whose subject matter is incorporated here by reference, provides the basis for a claim of priority of invention under 35 U.S.C. 119(a)-(d).

BACKGROUND OF THE INVENTION

The present invention relates to a guard for a hand-held power tool, in particular for an electric hand-held power tool, which includes a support surface for placement against a flange of the hand-held power tool, with a clamping device for fastening the guard to the flange, and with a rotation lock for fixing the angular position of the guard relative to the hand-held power tool.

Hand-held power tools, in particular electric hand-held power tools, with rapidly rotating disks, e.g., angle grinders, are equipped with a guard to protect the user from sparks, fragments, grinding particles, etc. The known guards are composed of a hood body and a clamping element. The clamping element is used to enclose a flange of the hand-held power tool, in particular an electric hand-held power tool. The flange encloses an axis that is the rotation axis of the rapidly rotating disk or the like. Screw connections or clamping levers are typically used to clamp the clamping element. The clamping produces a frictional connection between the flange and the guard, which fixes the guard in position and prevents it from rotating. To adjust the guard, the clamping element is released, thereby enabling the guard to be repositioned (i.e., to change its angular position). Once the guard has been repositioned, the clamping element is tightened once more. Guards are also known that realize the aforementioned frictional connection as well as a form-fit connection in order to fix the guard in place. This form-fit connection between the guard and the hand-held power tool is created by the fact that a lever installed on the hood or the hand-held power tool creates a form-fit connection with the electric hand-held power tool or the hood when in the neutral position, thereby providing reliable rotational locking.

SUMMARY OF THE INVENTION

With the inventive guard of the type described initially, it is provided that the support surface includes at least one rotation lock element, which is capable of interacting with a rotation lock counter-element of the flange. To this end, the contact surface between the hood and the flange, i.e., the support surface mentioned, includes at least one rotation lock element, which may interact with a rotation lock counter-element of the flange. The support surface is formed on the guard and is provided with the rotation lock element, thereby resulting in a very simple, effective design. The support surface is assigned directly to a hood body of the guard, and therefore lies in the zone of the hood body and not in a zone that belongs only to the clamping device. The inventive embodiment fulfills the requirements for increased safety, and fulfills the requirements of proposed standards, according to which fragments may not strike the user if the rotating disk breaks into four fragments of equal size, but are instead directed by the guard in the forward direction, e.g., away from the user. With the inventive design, a frictional connection is realized, as is a form-fit connection between the guard and the flange, so that extremely large forces may be absorbed. The guard is prevented from rotating out of a defined position, or it may be rotated by a maximum angle of 90°, thereby also complying with this standard. Via the rotation lock element, which interacts with the rotation lock counter-element, a type of profile is produced, which creates at least one latching position in which the guard is latched in place. When the guard is installed, this profile ensures that, when the clamping device is clamped, the hood remains in the desired position and does not slide as a result of the clamping procedure and move into an undesired position.

According to a refinement of the present invention, it is provided that the guard includes a hood body, and that the rotation lock element is designed/located on the hood body. As a result, the guard rests with its hood body directly on the flange of the hand-held power tool.

As an alternative, it is possible to locate the rotation lock element on a part of the clamping device assigned to the hood body. As a result, the rotation lock element is not located on just any part of the clamping device, but precisely in the zone that is assigned to the hood body, and it is overlapped by the hood body in particular.

It may be provided, in particular, that the rotation lock element is designed as a stamped element and/or a deep-drawn element. With stamping, no additional material is required. When stamping is carried out, a profile is created, which may interact with a counter-profile of the rotation lock counter-element.

It is provided in particular that the rotation lock element is designed as one piece with the component on which is it provided, or it is designed as a separate component, and it is attached to the hood body or the clamping device.

The support surface is preferably curved, and it is semicircular in shape in particular. Several rotation lock elements may be located along the curve. The rotation axis of the tool fitting of the hand-held power tool, in particular the electric hand-held power tool, is located in the center of the semicircle described above.

It is advantageous when the rotation lock elements are separated by the distance covered in one latching, or by a multiple thereof. A profile therefore results that has the same "pattern" around the circumference or a partial circumference of the support surface, thereby making it possible to attach the guard in this circumferential zone in form-fit positions with angular offsets relative to each other. The support surface may be semicylindrical or semiconical in design. The prefix "semi . . . " means that the support surface is assigned to the guard and may therefore not be full-sized in the circumferential direction (360°), since open space must remain for a working region in which the tool is not covered by the guard. The rotation lock element is not located in this open space. An axial lock between the guard and the flange may be formed by the semiconical shape. Another possibility is to design the support surface convex and/or concave in shape, as viewed in the axial direction. Preferably, this may also serve to form the axial lock mentioned above.

The flange is preferably designed as an annular flange. The rotation lock element is preferably designed as one piece with the flange, and the flange is preferably curved in design, in particular semicircular or circular in design. It is advantageous when several rotation lock counter-elements are located along the curve or semicircle or the circular design of the flange.

The rotation lock counter-elements may be separated by the distance covered in one latching, or by a multiple thereof. It is also possible for the flange to be cylindrical or conical in design, as mentioned above with regard for the support surface. The support surface and flange are always designed with matching shapes. It is also advantageous when the rotation lock element and the rotation lock counter-element engage in each other with matching shapes.

To form an axial lock, it is particularly advantageous when at least one guide projection is formed on the support surface or the flange, which engages in a circumferential recess or semicircumferential recess of the flange or support surface. The circumferential recess or semicircumferential recess may be designed as a circumferential groove or semicircumferential groove.

A clamping band is preferably provided as the clamping device. The clamping band may be separate from the guard, and it may extend over a section of the guard, i.e., a region of the hood body, or it is a clamping band attached to the hood body. The rotation lock element may be located on the zone of the clamping band that extends over the region of the hood body. It is advantageous, in particular, when the clamping band is designed as one piece with the guard. This is realized, e.g., by designing the guard with at least one and preferably two clamping strips that are formed as one piece with the hood body. The clamping band is preferably clamped using a clamping closure, which may be designed as a screw connection in particular.

The present invention also relates to a hand-held power tool, in particular an electric hand-held power tool, with a guard and a flange as described above.

BRIEF DESCRIPTION OF THE DRAWING

The drawing serves to explain the present invention, with reference to exemplary embodiments.

FIGS. 10*a* through 10*e* show various designs of support surfaces, i.e., semi-/cylindrical (a), semi-/conical (b), semi-/conical (c), convex (d), concave (e), FIGS. 11*a* through 11*f* show combination shapes of the support surface, FIGS. 12*a* through 12*c* show profile shapes of the rotation lock (rotation lock element and/or rotation lock counter-element), in different variants, FIGS. 13*a* through 13*e* show combination forms of profiles according to FIG. 12, and FIG. 14 shows a top view of the guard attached to the flange.

DESCRIPTION OF THE PREFERRED EMBODIMENTS

Figure 1:
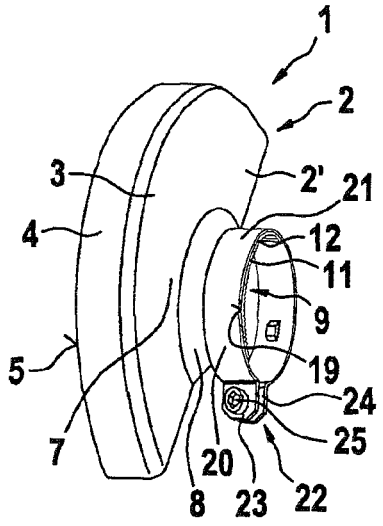
FIGS. 1 and 2 show a guard with a clamping band located on the outside.
Figure 7:
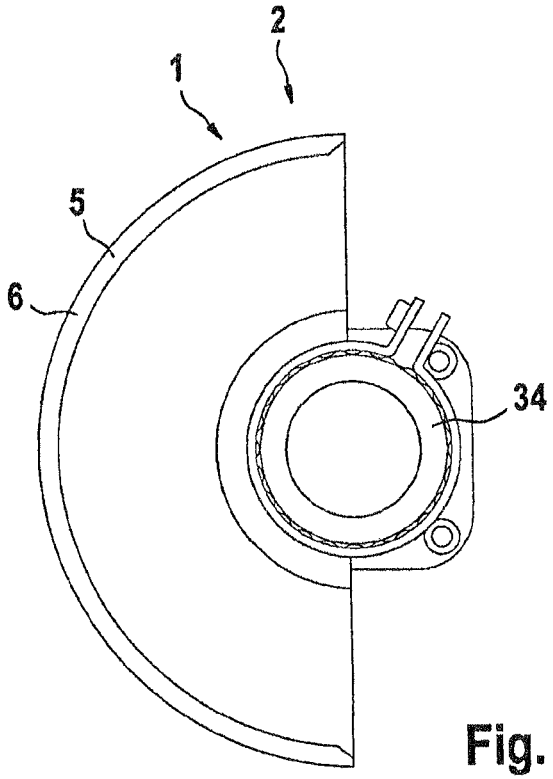
FIG. 7 shows a guard attached to a flange of a not-shown hand-held power tool, in particular an electric hand-held power tool.

FIG. 1 shows a guard 1 for a not-shown hand-held power tool, in particular an electric hand-held power tool, e.g., an angle grinder, with a rapidly rotating disk. Guard 1 includes a hood body 2 with an axial surface 2', which is designed as a semicircular surface (180°) and from which a semicircumferential surface 4 extends, in outer region 3. Axial surface 2' and semicircumferential surface 4 are preferably located at right angles to each other. End edge 5 of semicircumferential surface 4 is curved radially inwardly, as shown in FIG. 7 in particular. Radially inwardly drawn edge 5 forms an overreaching protective edge 6 for a rapidly rotating disk—which is not shown in the figures—of the electric hand-held power tool.

Axial surface 2' transitions into a conical surface 8 toward inner region 7. Support surface 9 extends outwardly from conical surface 8, and it extends cylindrically relative to a rotation axis 10—shown in FIG. 2—of the not-shown rotating disk and forms support surface 9 for placement on a flange—not shown in FIGS. 1 and 2—of the electric hand-held power tool. Axial surface 2', semicircumferential surface 4, overreaching protective edge 6, conical surface 8, and support surface 9 are formed as one piece with each other, preferably as a sheet-metal piece, in particular as a one-pieced hood body 2.

Figure 2:
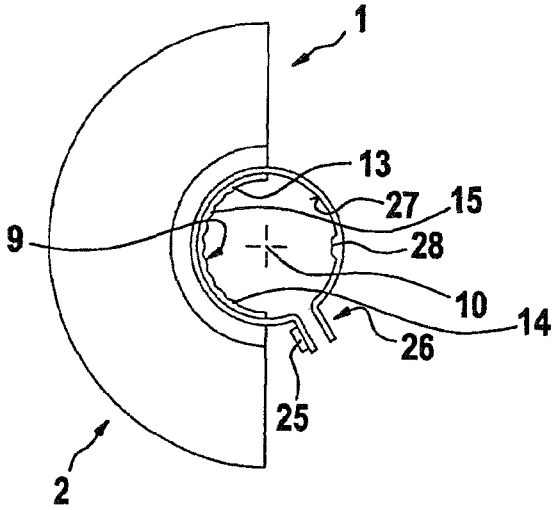
Figure 9:
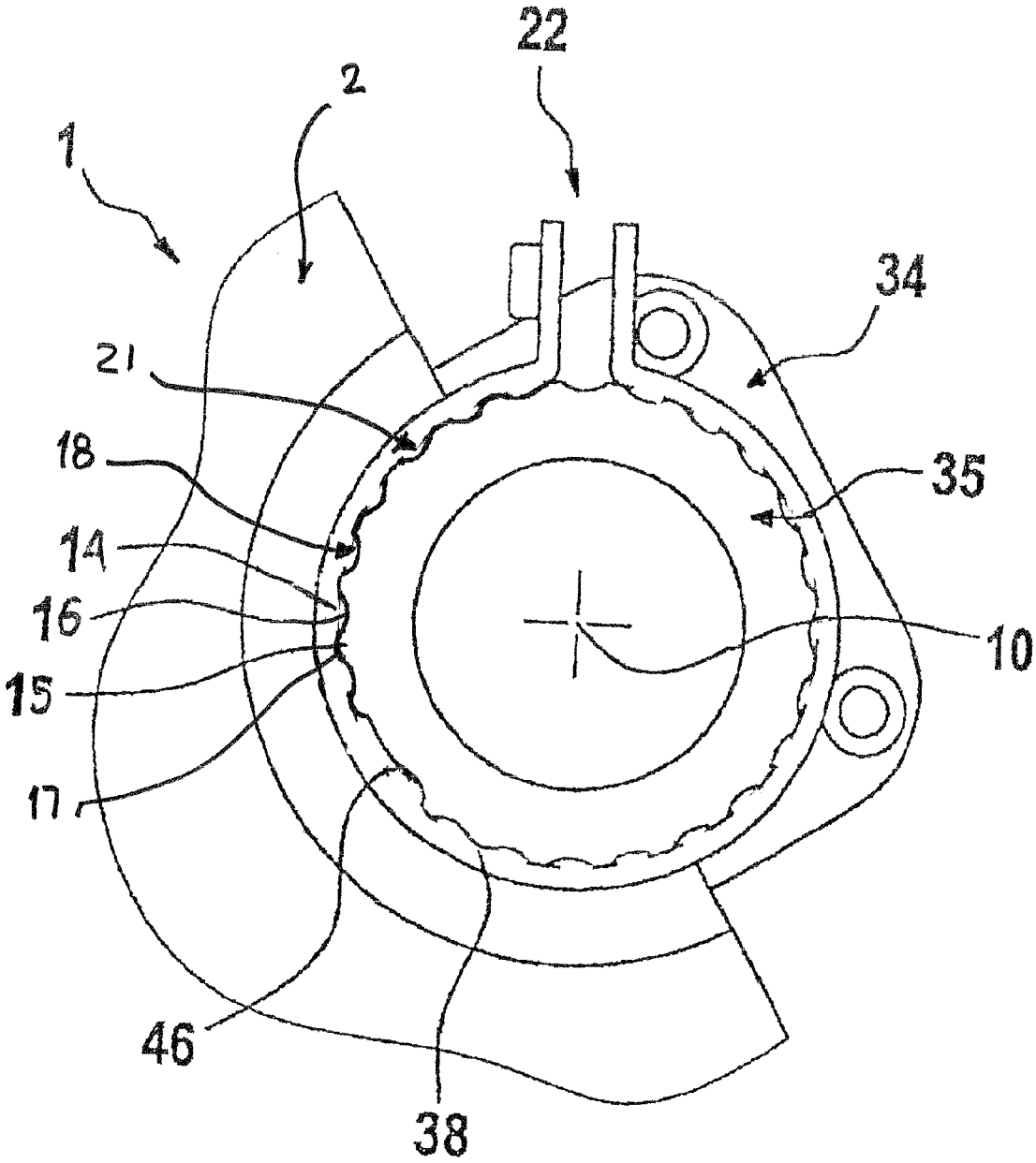
FIG. 9 shows a detailed view of a profiled support surface of the guard in a form-fit position on a flange with a counter-profile.

Support surface 9 forms a semiannular surface 11, with which the circumferential angle preferably extends around 180°, as is the case with the other surfaces mentioned. Support surface 9, i.e., the entire sheet-metal region that forms support surface 9, is profiled in design, i.e., it has a profile 12. The cross-sectional structure of support surface—as shown in FIG. 2—therefore does not mathematically form a semicircle, but rather a superposed zig-zag structure 13, thereby resulting in tooth-like raised areas 14 with recesses 15 between them, as viewed around the partial circumference. As shown in FIG. 9, the raised areas 14 have peak lines 16, which extend axially. Recesses 15 have base lines 17, which also extend axially, i.e., in the direction of rotation axis 10. Individual raised areas 14 form rotation lock elements 18 that interact with matching rotation lock counter-elements of the abovementioned flange of the hand-held power tool, as is described in greater detail below.

According to FIGS. 1 and 2, outer side 19 of support surface 9 is overlapped by a clamping device 20, which is designed as clamping band 21. Clamping band 21 is separate from hood body 2, although it is attached to hood body 2 using suitable means, in particular to outside 19 of support surface 9. The attachment is preferably carried out using welding. Clamping band 21 has a circular cross section and includes a clamping closure 22 in the form of angled clamping band ends 23 and 24. Clamping band end 23 includes a thread receptacle 25, and clamping band end 24 includes a through-bore 26, thereby enabling the diameter of clamping band 21 to be reduced using a not-shown threaded screw that is inserted into through-bore 26 and crewed into thread receptacle 25. Clamping therefore takes place on the aforementioned flange of the hand-held power tool, in particular an electric hand-held power tool.

Inner side 27 of clamping band 21 is provided with a guide projection 28, which may be created, in particular, by creating two parallel separating sections of clamping band 21—which is made of sheet metal—and designing the sheet-metal region located between the separating sections to extend radially inwardly.

Figure 3:
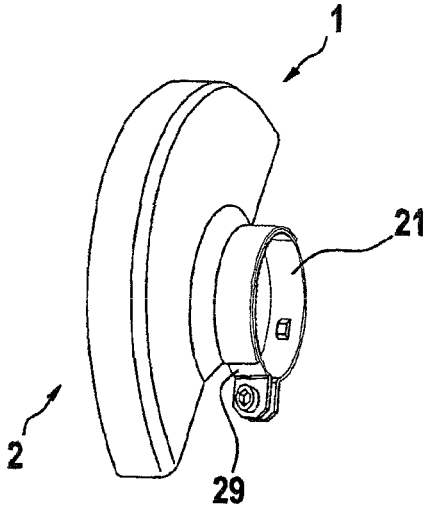
FIGS. 3 and 4 show a guard with a clamping band located on the inside.
Figure 4:
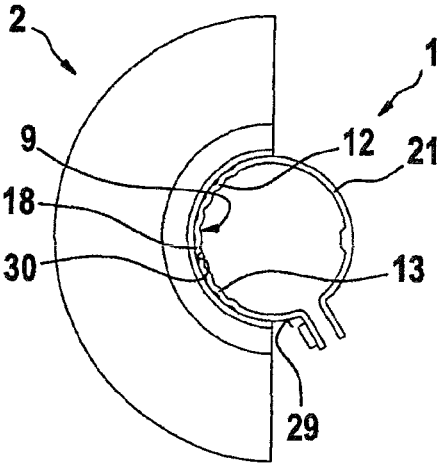

The exemplary embodiment shown in FIGS. 3 and 4 differ from the exemplary embodiment shown in FIGS. 1 and 2 only in that clamping band 21 is not designed as a clamping band on the outside, but rather as clamping band 21 on the inside, i.e., outside 29 of clamping band 21 bears against inner side 30 of the corresponding part of hood body 2, so that support surface 9 is formed by the inner side of clamping band 21 in the zone that overlaps the aforementioned part of hood body 2. A semicircular section (FIG. 4) of clamping band 21, i.e., support surface 9, includes a profile 12 with a zig-zag structure 13. Hood body 2 is welded with outside 29 of clamping band 21. Hood body 2 may also include a profile, thereby enabling the two profiles of hood body 2 and clamping band 21 to engage in each other in a form-fit manner. The profile of support surface 9 forms at least one rotation lock element 18 toward a not-shown flange.

Figure 5:
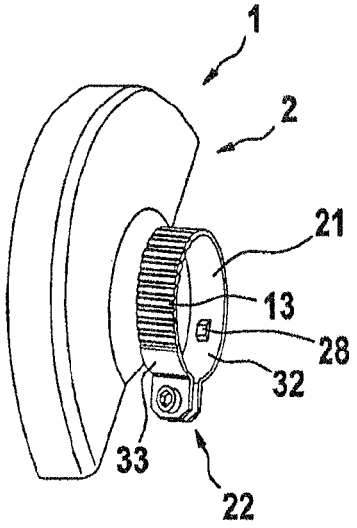
FIGS. 5 and 6 show a guard with an integrated clamping band that is formed as one piece with the hood.
Figure 6:
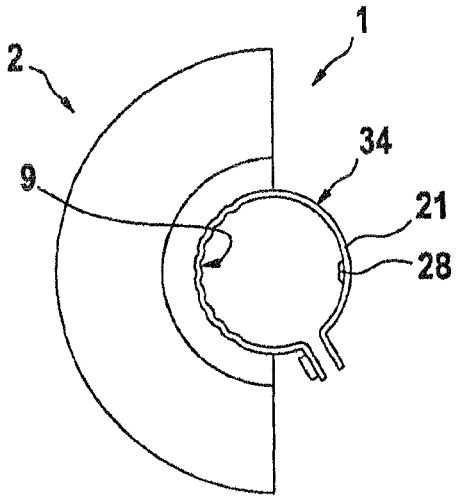

With the exemplary embodiment shown in FIGS. 5 and 6, the only difference from the exemplary embodiment shown in FIGS. 1 and 2 is that clamping band 21 is not designed as a separate part, but rather as one piece with hood body 2, i.e., support surface 9 of hood body 2 with zig-zag structure 13 transitions as one piece into two clamping strips 32 and 33, thereby also resulting in one clamping band 21 with a clamping closure 22.

In all, it should be noted that profile 12, i.e., rotation lock elements 18 formed as a result, have the same shape, i.e., lock rotation elements 18 are separated by the distance of one latching or by a multiple thereof.

Figure 8:
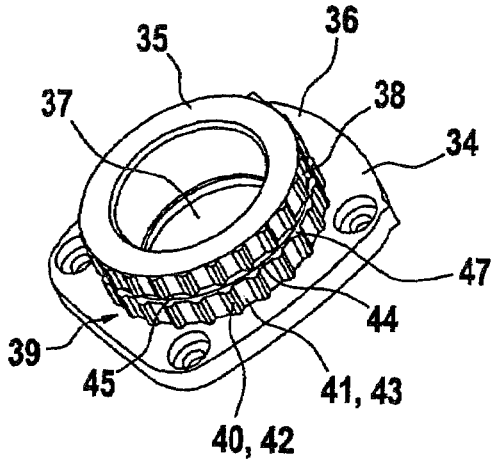
FIG. 8 shows a perspective view of a flange.

FIG. 8 shows flange 34 of the hand-held power tool, in particular an electric hand-held power tool, which is designed as annular body 35 with fastening segment 36. A ball bearing may be inserted in an inner opening 37 of annular body 30 to support a shaft—on which a tool is mounted—which rotates around rotation axis 10 (FIG. 9). Outer side 38 of annular body 35 of flange 34 is provided with a counter-profile 39 for interacting with profile 12 of guard 1. Counter-profile 39 includes tooth-like raised areas 40 and recesses 41 located between them. Raised areas 40 have peak lines 42, and recesses 41 have base lines 43. Peak lines 42 and base lines 43 extend axially, i.e., parallel, to the direction of rotation axis 10.

Outer side 38 of annular body 35 is provided with a circumferential recess 41 in the form of a circumferential groove 45 in the region of counter-profile 39. Moreover, annular body 35—as shown in FIG. 9—includes an insertion recess 46 on its outer side 38 for guide projection 28 of clamping band 21.

Due to counter-profile 39, rotation lock counter-elements 47 are formed on flange 34, which may interact with rotation lock elements 18 of guard 1 in a form-fit manner and via their matching shapes, thereby forming a rotation lock of guard 1 on flange 34. Counter-profile 39 has an even design, as does profile 12. Individual rotation lock counter-elements 47 are therefore separated by the distance of one latching, or by a multiple thereof. The distance of one latching of rotation lock elements 18 corresponds to the distance of one latching of rotation lock counter-elements 47, thereby enabling guard 1 to be fastened to flange 34 in desired angles of rotation in accordance with the latch-in distance, by installing it axially and then clamping the clamping device 20, as shown in FIGS. 7 and 9. When installing guard 1 on flange 34 axially, an angular position of the two parts must first be selected, and in such a manner that guide projection 28 may enter insertion recess 46. When guard 1 has been slid entirely onto annular body 35 of flange 34, guide projection 28 lies inside circumferential groove 45, thereby forming an axial lock. If clamping band 21 has not been tightened, guard 1 may be rotated relative to flange 34. Once the desired rotational position of these parts has been attained, clamping band 21 is tightened by closing clamping closure 22, thereby reducing its diameter. A frictional connection and a form-fit connection are thereby formed between guard 1 and flange 34. The form-fit connection is created via the meshed rotation lock elements 18 and rotation lock counter-elements 47. Profile 12, which is assigned to hood body 2, preferably extends around only a portion of the circumference; counter-profile 39 of flange 34 preferably extends around the entire circumference.

Very strong forces of the type that may occur if the rotating disk were to break may be absorbed by the form-fit connection—created according to the present invention—between guard 1 and flange 34. Profile 12, in interplay with counter-profile 39, also creates latching positions, which allow guard 1 to latch into position when it is adjusted, thereby ensuring that the selected position is maintained when clamping device 20 is clamped.

The following possibilities and advantages also result from the present invention: The clamping band may be designed as an annular band, in particular as a smooth ring. As an alternative, the clamping band is not circumferential, but rather is designed as a one-piece extension of the guard neck (support surface 9). Flange 34 of electric hand-held power tool forms an interface with guard 1. Due to profile 12 and counter-profile 39, guard 1 may be fastened on flange 34 in a frictional and non-positive manner in a large number of angular positions. Profile 12 and counter-profile 39 extend parallel with rotation axis 10, as mentioned above. Other profile shapes are also feasible, however, e.g., with a pitch, similar to a thread pitch of a screw, a herringbone profile, similar to herringbone teeth in gears, or a profile shape with variable pitch. The profile and/or counter-profile may be designed to extend 360° or to extend only around a semicircle or part of a curve. Different cross-sectional configurations between the supporting surface and the flange are feasible in order to form an axial lock, e.g., truncated cone shapes and/or concave and/or convex contact surfaces.

As described above, the contact surface, in particular the support surface, between guard 1 and flange 34 may be cylindrical or semicylindrical, and/or conical or semiconical, and/or convex and/Or concave. Combined forms of these shapes are also possible, i.e.,—as viewed along the axial length—cylindrical or semicylindrical, and conical or semiconical. It is also possible to select, e.g., conical or semiconical shapes, it being possible to form necks or angular shapes using two conical sections that are slanted toward each other. The rotation lock, which is formed by the at least one rotation lock element 18 in combination with the at least one rotation lock counter-element 47, may also have a profiled shape, i.e., it may extend axially as a straight line or at a diagonal to rotation axis 10, it may be curved or be a combination of the profile shapes described. When the shape is beveled, angled sections may also be specified.

When clamping band 21 is connected with the neck of hood body 2 by welding, in particular spot welding, profiling is preferably not provided or stamped in the region of the spot welding sites, in order to attain the best possible contact zones. FIG. 10 shows various support surface designs. FIG. 11 shows combination shapes of support surface designs, FIG. 12 shows profile shapes of the rotation lock, and FIG. 13 shows combination shapes of profiles.

It is important in particular to design the profiles of the rotation lock such that flange 34 and guard 1 do not form an undercut in a certain direction, which is indicated in FIG. 14 with an arrow. During adjustment, guard 1 moves automatically via accumulation of forces in support surface 9 in this direction and disengages the profile, thereby making it possible for guard 1 to rotate relative to flange 34. As a result, comfortable handling with a minimal amount of force is made possible. Based on the description provided above, it is clear that the profile assigned to the guard must be capable of moving over the profile of the flange in a latching manner when the clamping device has not been tightened. This rotational capability is only given, however, when the profile of guard 1 extends only around an angular range that is less than 180° and therefore does not require that the guard neck or the like expand during rotation. Rather, when rotated, the guard moves in the direction of the arrow shown in FIG. 14, without guard 1 undergoing plastic deformation. If the profile assigned to guard were 180° or nearly 180°, undercuts would be formed, i.e., a motion in the direction of the arrow shown in FIG. 14 would not be possible without guard 1 or its neck being expanded. Since guard 1 is preferably composed of a relatively stiff sheet-metal material, however, an expansion of this type should be prevented. It is also possible, of course, as an alternative, to manufacture the guard out of a resilient material, so that expansion may occur. The profile of the guard could then definitely have an angular range of 180°. It is also feasible, of course, as an alternative, for the undercuts described to be permitted with unflexible hoods. As a consequence, however, the handling would be less comfortable when adjustments are made, since it would then be necessary to always remove guard 1 axially from the flange, to adjust the new angular settings, and to then insert the guard axially onto the flange once more in the new position. It would not be possible to perform adjustments in a convenient, latching manner.

What is claimed is:

1. A guard for a hand-held power tool, in particular for an electric hand-held power tool, comprising a hood body; a semicircular support surface for placement against an annular body of a flange of the hand-held power tool; a clamping device including a clamping band for fastening the guard to the flange; and a rotation lock for fixing an angular position of the guard relative to the hand-held power tool, wherein the rotation lock includes a plurality of rotation lock elements arranged along the support surface and interactable with a plurality of corresponding rotation lock counter elements of the annular body of the flange, wherein the support surface is located on an element selected from the group consisting of the hood body and the clamping band in a zone that overlaps the hood body.

2. The guard as recited in claim 1, wherein the rotation lock elements are designed as elements selected from the group consisting of a stamped element, a deep-drawn element, and both.

3. The guard as recited in claim 1, wherein the support surface is curved, and is semicircular in particular, and the several rotation lock elements, in particular, are located along the curve.

4. The guard as recited in claim 3, wherein the rotation lock elements are separated by the distance covered in one latching, or covered by multiple latchings.

5. The guard as recited in claim 1, wherein the support surface is semicylindrical or semiconical in design.

6. The guard as recited in claim 1, characterized by an axial lock between the guard and flange.

7. The guard as recited in claim 1, wherein the support surface—as viewed in the axial direction—is configured as a surface selected from the group consisting of a convex surface, a concave surface, and both, in particular to form the axial lock.

8. The guard as recited in claim 1, wherein the rotational lock counter elements are formed as one piece with the annular body of the flange.

9. The guard as recited in claim 1, wherein the annular body of the flange is curved, in particular semicircular or circular, and the rotation lock counter-elements are preferably located along the curve.

10. The guard as recited in claim 9, wherein the rotation lock counter-elements are separated by the distance of one latching, or by the distance of multiple of latchings.

11. The guard as recited in claim 1, wherein the annular body of the flange is cylindrical or conical in design.

12. The guard as recited in claim 1, wherein the annular body of the flange—as viewed in the axial direction—is configured as a flange selected from the group consisting of a convex body of the flange, a concave body of the flange, and both, in particular to form the axial lock.

13. The guard as recited in claim 1, wherein the rotation lock elements and the rotation lock counter-elements engage in each other via their respective matching shapes.

14. The guard as recited in claim 1, wherein at least one guide projection is formed on the support surface and engaging in a recess selected from the group consisting of a circumferential recess and a semicircumferential recess in the annular body of the flange.

15. The guard as recited in claim 1, wherein the circumferential recess or semicircumferential recess is designed as a groove selected from the group consisting of circumferential groove and a semicircumferential groove.

16. The guard as recited in claim 1, wherein the clamping device includes a clamping band.

17. The guard as recited in claim 1, wherein the clamping band is configured as an element which is attached to the hood body.

18. The guard as recited in claim 1, wherein the clamping device includes a clamping closure.

19. The guard as recited in claim 1, wherein the clamping closure is designed as a screw connection.

20. A hand-held power tool, particularly an electrical hand-held power tool, with a guard and a flange as recited in claim 1.

21. A guard for a hand-held power tool as recited in claim 1, wherein the zig-zag structure has tooth-shaped areas having recesses and peak lines for forming the rotation lock elements.

22. A guard for a hand-held power tool, in particular for an electric hand-held power tool, comprising a hood body; a semicircular support surface for placement against an annular body of a flange of the hand-held power tool; a clamping device including a clamping band for fastening the guard to the flange; and a rotation lock for fixing an angular position of the guard relative to the hand-held power tool, wherein the rotation lock includes a plurality of rotation lock elements arranged along a partial circumference of the support surface and interactable with corresponding rotation lock counter elements of the annular body of the flange, wherein the support surface is located on an element selected from the group consisting of the hood body and the clamping band in a zone that overlaps the hood body and wherein the support surface is provided with a zig-zag structure forming the rotation lock elements.

23. A guard for a hand-held power tool, in particular for an electric hand-held power tool, comprising a hood body; a semicircular support surface for placement against an annular body of a flange of the hand-held power tool; a clamping device including a clamping band for fastening the guard to the flange and a rotation lock for fixing an angular position of the guard relative to the hand-held power tool, wherein the rotation lock includes a plurality of rotation lock elements arranged along the support surface and interactable with a plurality of corresponding rotation lock counter elements of the body of the flange, wherein the support surface is located on an element selected from the group consisting of the hood body and the clamping band in a zone that overlaps the hood body and wherein the support surface is provided with a wave structure forming the rotation lock elements.

* * * * *